US005308083A

United States Patent [19]

Grunfeld et al.

[11] Patent Number: 5,308,083

[45] Date of Patent: May 3, 1994

[54] REBOUNDING PORTABLE SOCCER GOAL AND METHOD OF USE

[76] Inventors: Dan Y. Grunfeld, P.O. Box 592, 1200 Madison St.; John P. Hencmann, 570 Jackson St., both of Denver, Colo. 80206

[21] Appl. No.: 135,174

[22] Filed: Oct. 12, 1993

[51] Int. Cl.[5] ..... A63B 63/02

[52] U.S. Cl. ..... 273/400; 273/396

[58] Field of Search ..... 273/400, 401, 396, 398

[56] References Cited

U.S. PATENT DOCUMENTS

| | | | |
|---|---|---|---|
| 4,083,561 | 4/1978 | Daffer, Jr. | 273/411 X |
| 4,116,446 | 9/1978 | Thompson | 273/181 F |
| 4,127,272 | 11/1978 | Pennell | 273/398 |
| 4,258,923 | 3/1981 | Senoh | 273/398 |
| 4,286,786 | 9/1981 | Papadopoulos | 273/396 |
| 4,407,507 | 10/1983 | Caruso et al. | 273/400 |
| 5,048,844 | 9/1991 | Haseltine | 273/400 |
| 5,080,375 | 1/1992 | Moosavi | 273/400 |

*Primary Examiner*—William H. Grieb

*Attorney, Agent, or Firm*—Beaton & Swanson

[57] ABSTRACT

A portable soccer goal with rebounding net to return a ball struck into the net. The frame of the goal is formed by a pair of vertical posts and a long horizontal tube and is secured to the ground by a pair of base supports. Pivotable struts further support the vertical posts. The net has a sleeve that positively joins the net to the frame over the entire horizontal length of the frame, and there is a resilient mainstay cord threaded into the net near the periphery. The net and mainstay cord are secured by hooks at the base supports, and the net is oriented to the outside of the struts. When the struts are spread outwards, the tension in the net is increased so as to be sufficient to rebound a ball struck into the net.

5 Claims, 2 Drawing Sheets

REBOUNDING PORTABLE SOCCER GOAL AND METHOD OF USE

FIELD OF THE INVENTION

This invention relates to soccer goals, and more particularly to a soccer goal with a rebounding net for returning the ball to the kicker. The soccer goal of this invention is safe because its surfaces are smooth, and it is stable, light weight, portable, and adjustable. The invention has particular utility for practicing the game and for use in short field soccer games such as 3v3 and 7v7. The soccer goal of this invention may be used as a training device, a coaching device, and for recreational play.

BACKGROUND OF THE INVENTION

A soccer goal is a rectangle into which a soccer ball is kicked in order to score in the game of soccer. A typical goal is framed by two vertical posts joined by a horizontal top post and enclosed by a net attached to the posts and drawn back behind them so as to contain any ball struck into the goal. Such soccer goals are well known and are in common use for regulation games and practice exercises.

There are, however, several problems associated with using a regulation soccer goal for certain applications. Such applications that raise problems for a traditional soccer goal include short field soccer games, practice exercises, and the need for portable or removable soccer goals in fields designed for multiple use.

In order to conserve space, a "short field" version of soccer has emerged for recreational and club play. Using a short field, fewer players and sometimes no goalie, a 3-person team ("3v3") or a 4-person, 5, 6, 7, 8 or other "short-handed" teams may be fielded.

Because space in the short field game is at a premium and, when played without a goalie, there is no need for a goalie to stand within the goal, it would be desirable to foreshorten the area within the goal enclosed by the net. Because the players in the short field game are running at full speed in a relatively small area, it would be desirable to have a goal that is strong, stable, but also safe—among the safety concerns would be the elimination of sharp edges and protruding objects such as bolts, nuts and other fasteners.

Practice exercises and drills for soccer include many versions of taking a shot on goal. A hard, accurate kick with an eye towards taking a follow-up shot if an initial shot is deflected, rebounded or blocked out of the goal is desirable. To maximize the efficiency of practice drills, it would be desirable for a player to be able to strike a ball into a soccer goal that simulates a traditional soccer goal but which will rebound the ball so that a player may take a series of rapid fire shots on goal, and/or take a power shot on goal and immediately follow through with a rebounding shot after the first shot is deflected back out of goal. Such practice objectives will also be served by a compact goal so that several such goals may be setup within the limited space of a practice field.

Finally, although there remain fields dedicated to playing soccer in which heavy, semi-permanently installed traditional soccer goals may be affixed, many soccer games are played in less permanent surroundings. Where space is at a premium, a practice soccer goal, a short field game soccer goal, or even a very large number of weekend tournament or club sport goals must be moved, positioned, setup, used and then disassembled and removed with relative ease. It would be desirable, therefore, to have a stable soccer goal that is also light weight, portable and relatively easy to setup and remove. Likewise, because soccer is practiced everywhere, but because an empty field, street, driveway or even a solid wall afford little in the way of practicing a kick on goal, a stable and portable soccer goal would be desirable.

To summarize, it would be highly desirable in short field soccer, practice exercises, and soccer played in multiple use areas to have a soccer goal that is safe, stable, light weight, portable, easy to setup and remove, and that also returns the ball to the kicker after the ball is struck into the net.

Examples of previous work done in providing a soccer practice goal, or a portable training goal are described in U.S. Pat. Nos. 4,083,561 of Daffer for a soccer practice net; 4,116,446 of Thompson for a game net support apparatus; 4,127,272 of Pennell for a portable soccer goal; 4,258,923 of Senoh for a football goal structure; 4,407,507 of Caruso for a portable soccer goal; 5,048,844 of Haseltine for a portable rebounding soccer training goal; and 5,080,375 of Moosavi for an adjustable soccer goal.

None of the prior art of which the applicant is aware fully solves the problem of providing a safe, stable, light weight, portable, easy to setup and remove soccer goal that also returns the ball to the kicker after the ball is struck into the net. It is the object of this invention to answer those needs.

SUMMARY OF THE INVENTION

This invention includes a frame formed by a pair of vertical posts and a long horizontal tube. The long horizontal tube is assembled from two horizontal bars that telescope into a horizontal connector which joins them together. The outermost ends of the horizontal bars are bent into an arced 90° curve, and the curved ends telescope into the top ends of the vertical posts.

Two base supports having a support tube at one end and prongs at the other end are driven into the ground with the prongs securing the base supports in the ground, and with the support tubes projecting above the ground. The vertical posts telescope onto the support tubes so as to stand the frame of the goal up on the base supports.

Behind each of the vertical posts is a strut. Each strut has a J hook that is fed into the vertical post by way of a hole in the back of the vertical post. The J-hook makes secure contact within the interior of the vertical post and permits a pivotal attachment of the struts to the vertical posts. The struts are then angled back of the frame and secured to the ground by spikes to stabilize the frame. Moreover, the struts can be spread outwards from the frame so as to increase net tension.

The net used in this goal is folded back over itself to form a sleeve so that the net may be threaded over the frame to make positive contact over the entire length of the horizontal bar and over the upper portion of the vertical posts. At the bottom corners of the frame, the net is securely attached to the base supports. Behind the frame, the net is placed on the outside of the struts so that the net tension can be increased as the struts are spread outwards. A mainstay rope of resiliently stretchable material is woven into the periphery of the net so as to further increase the net tension.

This combination of features provides a safe, stable, light weight, portable, easy to setup and remove soccer goal that also returns the ball to the kicker after the ball is struck into the net.

DETAILED DESCRIPTION OF THE INVENTION

This invention provides a safe, stable, light weight, portable, easy to setup and remove soccer goal that also returns the ball to the kicker after the ball is struck into the net.

Figure 1:
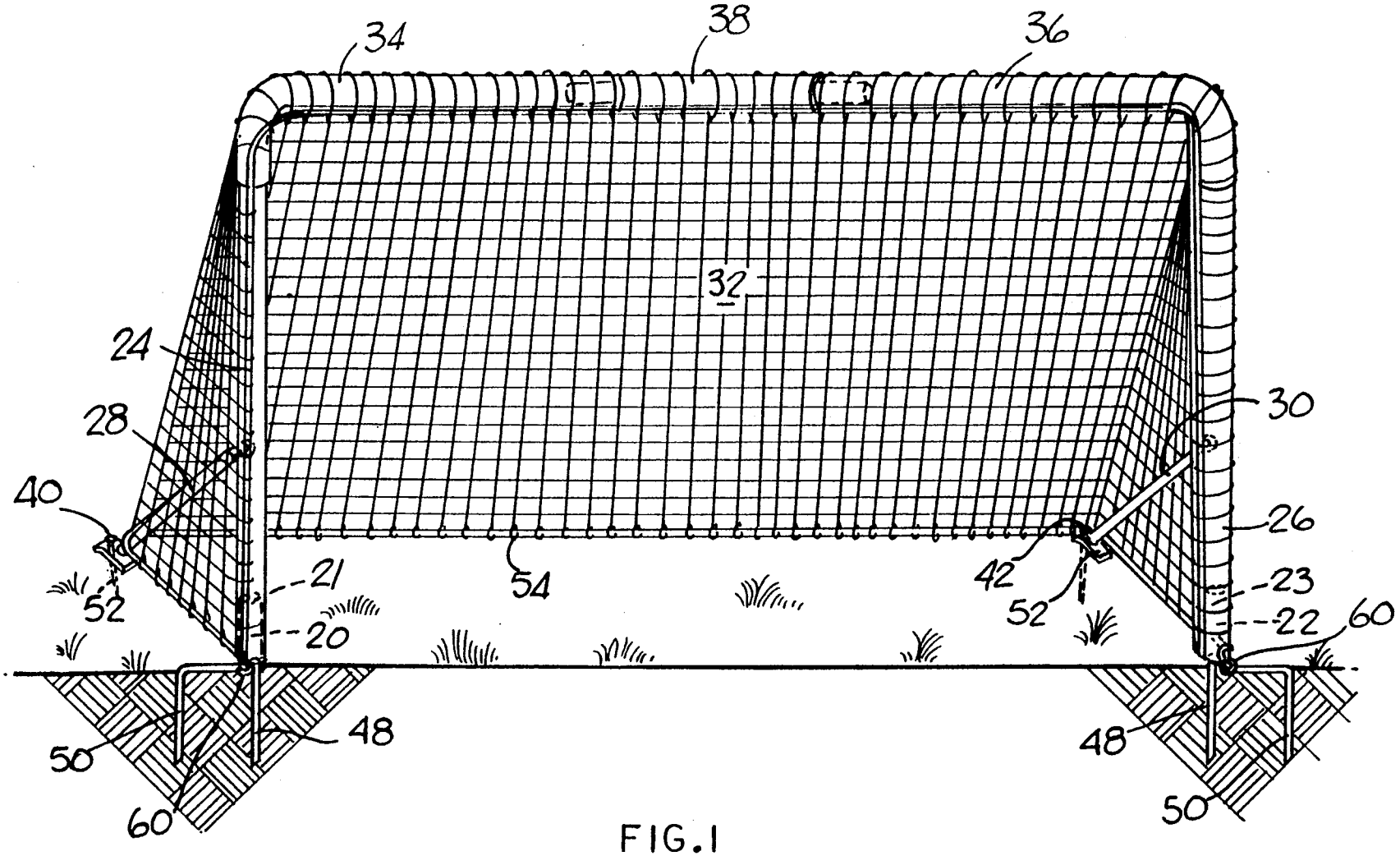
FIG. 1 is a perspective view of the rebounding soccer goal of this invention.

With reference to FIG. 1, it may be seen in overview that the basic soccer goal of this invention includes two base supports 20, 22; two vertical posts 24, 26; two struts 28, 30; a net 32; two horizontal bars 34, 36; a horizontal connector 38; and two spikes 40, 42.

The base supports 20, 22 are driven into the ground so that prong 48 and extending prong 50 are parallel to the face of the goal. A support tube 21 of base support 20, and a support tube 23 of base support 22 extend vertically above the level of the ground.

Vertical posts 24, 26 are tubes having an inner diameter slightly larger than the outer diameter of support tubes 21, 23 of base supports 20 and 22. The vertical posts 24, 26 are telescopically mounted on the support tubes 21, 23 of the base supports 20 and 22 so as to stand vertically above the ground.

The two horizontal bars 34, 36 are tubes joined together by the horizontal connector 38, which is a tube having at each end an outer diameter slightly smaller than the inner diameters of the horizontal bars for making a telescoping friction connection. The horizontal bars 34, 36 are each bent at their ends removed from the horizontal connector 38 so as to form an arced 90° bend to the vertical. The horizontal bars 34, 36 each have, at the vertically bent ends thereof, an inner diameter slightly larger than the outer diameter of the vertical posts 24 and 26 so that they may be connected to the vertical posts by a telescoping friction connection.

The struts 28, 30 are connected to the vertical posts 24, 26 in a manner that will be explained in more detail with reference to FIG. 3. It is sufficient for purposes of this overview to appreciate that the struts have J-hooks on one end and that they are pivotally connected to the posts 24, 26 at the J-hooked ends of the struts 28, 30 so that the struts may be angled back towards the ground and may also be spread outwards. On each strut 28, 30, at the end of the struts removed from the J-hook end, is a base 52 having a hole suitable for receiving a spike. The spikes 40, 42 pass through the hole in respective bases 52 and secure struts 28, 30 to the ground.

It may be seen that vertical posts 24, 26, horizontal bars 34, 36 and connector 38 form a frame for a soccer goal, and that the frame is supported by the base supports 20, 22 and by the tension struts 28, 30.

The net 32 is folded over itself at the portion of the periphery which will meet the frame to form a sleeve (not separately numbered). Accordingly, the net is positively secured to the frame when the vertical posts, horizontal bars and horizontal connector are fed into the sleeve. A mainstay rope 54 is threaded through the net 32 around the periphery of the net. An S-hook 60 at each of the base corners of the net 32 secures the respective base corners of the net (including the mainstay rope 54) to the base supports 20, 22, at a point near the junction of the respective extending prongs 50 and the support tubes 21, 23.

It may now be understood that the soccer goal of this invention may be assembled according to the following steps:

(a) threading the sleeve of the net 32 through one of the horizontal bars 34 or 36;

(b) pushing the horizontal connector 38 into the non-bent end of the horizontal bar on which the net is threaded;

(c) pushing the non-bent end of the other horizontal bar 34 or 36 over the other end of the horizontal connector 38, thereby forming one long horizontal tube, bent at each end with the net threaded through one end;

(d) placing the long horizontal tube on the ground and aligning it with the desired soccer goal orientation;

(e) driving the base supports 20, 22 into the ground at each end of the long horizontal tube, using the horizontal tube to judge the width of the goal, and orienting the prongs 48, 50 so that they are parallel with the face of the goal and so that the extending prongs 50 are on the outside of the goal;

(f) pushing vertical post 24 onto base support 20, and pushing vertical post 26 onto base support 22;

(g) attaching the J-hooked end of tension strut 28 to vertical post 24, and attaching the J-hooked end of tension strut 30 to vertical post 26, and spreading the struts so that base 52 of the struts rests upon the ground behind the goal;

(h) lifting the long horizontal tube and pushing the bent ends of the horizontal bars 34, 36 of the long horizontal tube onto the upper ends of the vertical posts 24, 26;

(i) spreading the net 32, by spreading the sleeve over the horizontal connector 38, the other horizontal bar, and the top portion of both of the vertical posts 24, 26 until the net is positively joined to nearly the entire perimeter of the goal frame (it will be remembered that the net was threaded over one of the horizontal bars 34, 36 in step (a) above);

(j) securing the base corners of net 32 to the base supports 20, 22 by connecting the S-hooks 60 at the base corners of the net to the base supports at the juncture of the respective extending prongs 50 of base supports 20, 22 and the bottom of the vertical posts 24, 26 (the mainstay rope 54 is also hooked to the S-hooks 60);

(k) pulling the sides of the net 32 over the tension struts 28, 30 and over the heads of spikes 40, 42; and (l) swinging the struts 28, 30 outwards so as to put increased tension in net 32, and then driving spikes 40, 42 through the base 52 of the struts so as to secure the soccer goal.

Disassembly is accomplished by reversing the foregoing steps.

Having described the soccer goal of this invention in overview, certain details of the invention will now be explained.

Figure 2:
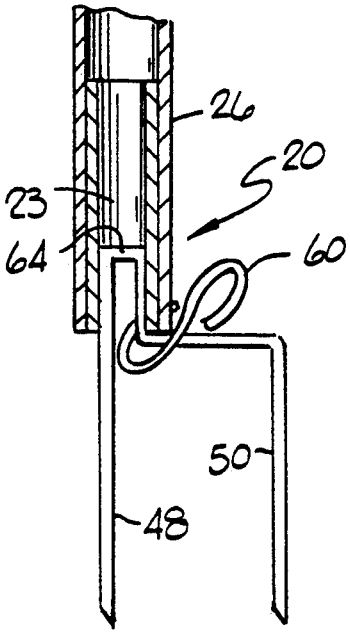
FIG. 2 is a detail, partially cut away elevational view showing the base support and prongs of this invention.

Base support 20 can be seen in more detail with reference to FIG. 2. In a preferred embodiment, the prongs 48 and 50 are fashioned by bending a single rod which is sharpened at both ends. A looped section 64 of the rod is dimensioned so as to fit snugly within support tube 23 of base support 20. This is advantageous in construction of the base support 20 because it permits a secure attachment of the two prongs 48 and 50 with a single weld on the inside of support tube 23. It may be appreciated that, when vertical post 26 is pushed over support tube 23, there is a smooth fit with no sharp edges and no protrusions above ground level.

Figure 3:
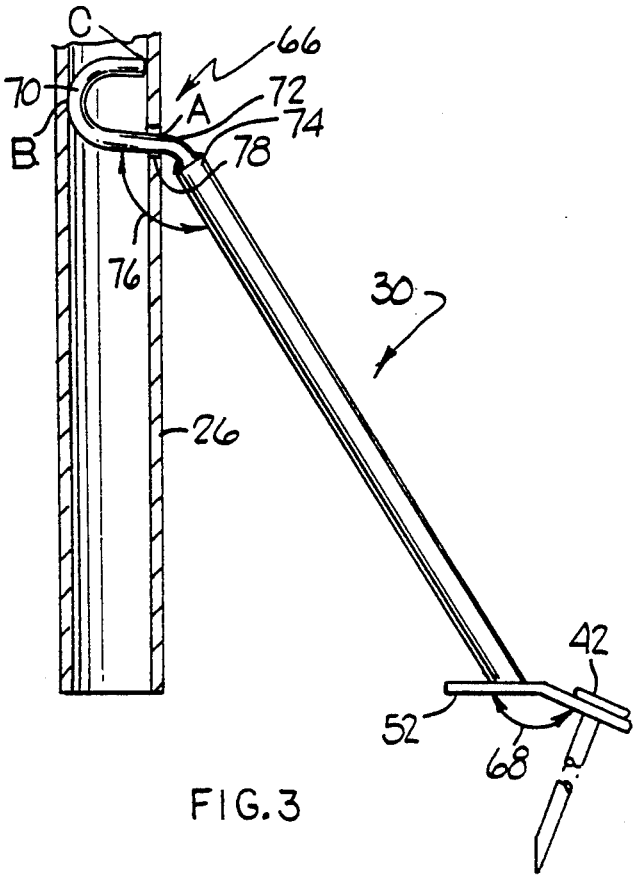
FIG. 3 is an elevational view showing the strut and vertical post of this invention.

Strut 30 can be seen in more detail with reference to FIG. 3. The strut has a J-hook 66 at one end for connecting the strut to one of the vertical posts 24, 26. The strut has a base 52 at the other end for securing the strut to the ground.

The base 52 of the strut is bent at an angle 68 and has a hole through which one of the spikes 40, 42 may be driven to secure the strut to the ground. At the hooked end of the strut, there is a J-hook 66 comprised of a hooked segment 70 and an extension segment 72 which joins the hooked segment to an end 74 of the strut. There is an angle 76 between extension segment 72 and end 74 of the strut.

The connection of strut 30 to vertical post 26 is made by passing hooked segment 72 through a hole 78 in the back of the vertical post. The hooked segment 70 is sized in relation to the interior diameter of post 26 so that the hooked segment will lodge inside the post with a three-point contact: a first point of contact (A) is made where the hooked segment meets hole 78 in post 26; a second point of contact (B) is made where a bend of the hooked segment meets the inner wall of post 26 opposite the hole; and a third point of contact (C) is made where the end of the hooked segment meets the inner wall of post 26 above the hole.

In an embodiment of this invention suitable for short field soccer, the frame is four feet in height by eight feet in width. Accordingly, in such an embodiment, vertical post 26 is about forty-three inches long. It has been found that good results are obtained when hole 78 is about eighteen inches up from the bottom of the vertical post 26; strut 30 is about twenty four inches in length; angle 78 is within the range of 45° to 65°, and, preferably, is 55°; and angle 68 is within the range of 20° to 30°, and, preferably, is 25°.

Although specific measurements may be varied, as would be apparent to one skilled in the art, the combinations set forth above work to permit a convenient attachment of the strut to the vertical post with room to feed hooked segment 70 into hole 78, to manipulate the strut into a three point contact inside the tube, and to pivot the strut into proper position. Importantly, these dimensions also permit the soccer goal to be set up with a depth of approximately twenty inches.

After the soccer goal has been set up, net 32 will be positively connected to the frame along the entire length of the horizontal bars, and over the top of the vertical posts because the sleeve will have been threaded over the frame (in a preferred embodiment, the sleeve is ten feet long—this suffices to cover the eight foot length of the combined horizontal bars, and to cover one foot on either side over the top of the vertical posts). Moreover, the net will be under tension because it is held securely in place by the frame; by the S-hooks 60 at the corners of the support posts 20, 22; and by the spikes 40, 42 at the bases 52 of the struts 28, 30.

The net tension is enhanced by spreading the struts 28, 30 outwards so as to pull the net 32 tight, and is further enhanced by using a resiliently stretchable cord as the mainstay rope 54 which circles the periphery of the net. When it is remembered that the mainstay rope is itself secured to the S-hooks 60 and the spikes 40, 42, it will be appreciated that a resiliently stretchable cord, such as one made of polyproplyene, will impart further tension to net 32.

The resulting structure is a soccer goal that provides ball return because of the combination of net tension and positive net contact with the frame—the net is tight enough to rebound a well struck ball, and there are no gaps through which the ball might be lost or which might trap the ball. The soccer goal is of minimum depth (in the embodiment described, it is about twenty inches deep) when assembled so as to help conserve space on a soccer field or other practice area.

The soccer goal of this invention has no protruding bolts or nuts, and has smooth fittings at all points above the ground. The soccer goal of this invention is stable because of the relation of forces (including the struts and the net tension against the struts and frame) that work to hold the entire unit together.

The soccer goal of this invention is portable, can be assembled and disassembled readily, and is relatively light weight. The light weight is achieved because of the absence of a second horizontal frame member (it will be noticed that there is only one horizontal member at the top of the frame; there is no second horizontal member at the bottom rear of the frame), and because stability is achieved not through bulk but through the forces working to hold the unit together.

A soccer goal has been constructed in accordance with the foregoing description using the following materials and specifications:

| | |
|---|---|
| Weight: | 26 pounds |
| Shipping Container size: | 12" × 49" × 2½" corrugated cardboard |
| Goal Composition: | Galvanized steel tubing, steel tubing, fabricated steel |
| Finish: | Baked enamel |
| Dimensions: | Fully assembled—4 ft. × 8 ft. × 20 inches (deep) Disassembled—contained in the shipping container |
| Net: | All nylon |
| Assembly time: | Approximately two minutes |
| Disassembly time: | Approximately two minutes |
| Weight stress: | Tested to 210 pounds (dynamic) exerted at the midpoint of the assembled goal |
| Site preparation: | None required |

Although the soccer goal may be resized, in a manner well known to those skilled in the art, the following specific dimensions and specifications have been found to yield good results:

| | |
|---|---|
| Horizontal bar 34, 36: | Tube, about fifty-seven inches in length: formed into the arced 90° bend—about forty-seven inches at one one side of the |

-continued

| | |
|---|---|
| | bend (horizontal), and about ten inches at the other side of the bend (vertical); about 1⅝ inch outer diameter; about 0.055 inch wall thickness |
| Connector 38 | Tube, about seventeen inches in length; about 1½ inch outer diameter; about 0.065 inch wall thickness |
| Vertical post 24, 26 | Tube, about forty-three inches in length; about 1½ inch outer diameter; about 0.065 inch wall thickness; hole (to receive the J-hook of the strut) about eighteen inches from the bottom end |
| Strut 28, 30 | Tube, about twenty-four inches in length; about ⅞ inch outer diameter (the J-hook is prefabricated of ⅜ inch cold rolled steel, and is welded into one end of the strut tube; the base plate is attached to the other end of the strut tube, and the base plate is a steel plate about two inches by 3½ inches by ⅛ inch thick) |
| Spike 40, 42 | Pointed 5/16 inch rod about ten inches in length, with large plastic (e.g., LEXAN-brand) or rubber head |
| Support tube 21, 23 | Tube, four to six inches in length; about 1¼ inch outer diameter; about 1 inch inner diameter |
| Prongs and looped section 48, 50, 64 | 5/16 inch rod, pointed at each end, about twenty-four to twenty-eight inches in length: bent and looped so that loop fits within the inner diameter of the support tube; extension prong (50) is spaced about three inches out from the juncture of the rod and the support tube, and prongs (48 and 50) extend about six inches beneath the juncture of the rod and the support tube |

Figure 4:
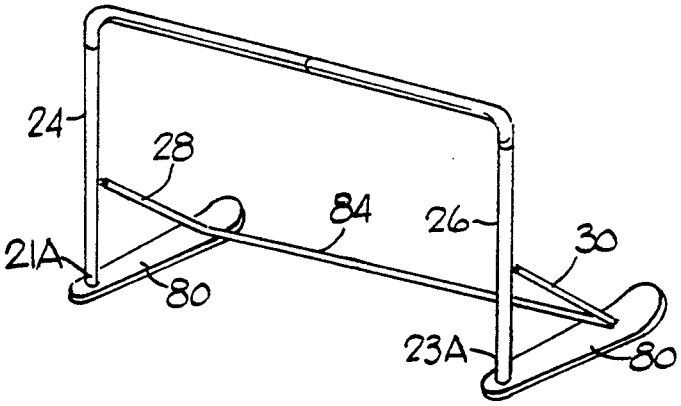
FIG. 4 is a perspective view of the rebounding soccer goal of this invention, showing an alternative set of base supports for use on a hard surface.

The foregoing description included standard base supports 20, 22 with prongs 48, 50 for outdoor use. Indoor/outdoor solid surface adapters are available. These adapters use a vinyl coated, non-scuff, non-marking heavy weighted base. With reference to FIG. 4, it may be seen that the indoor/outdoor adapters 80 in the form of plate are set so as to support the vertical posts 24, 26 by way of support tubes 21A, 23A set at one end of the adapters 80. Support tubes 21A and 23A have an outer diameter slightly smaller than the inner diameter of the vertical posts 24, 26. The vertical posts 24, 26 are telescopically mounted on the support tubes 21A, 23A of the adapters 80 so as to stand vertically above the ground. In a similar fashion, the adapters 80 have support posts (not shown in FIG. 4) at the other end of the adapters for securing an open end of the respective struts 28, 30 to the adapters 80. A spacer bar 84 stabilizes the goal.

Figure 5:
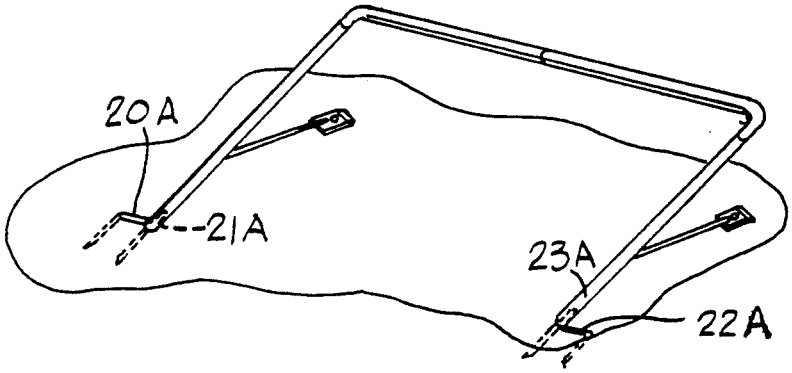
FIG. 5 is a perspective view of the rebounding soccer goal of this invention, showing an alternative set of base supports for returning the rebounded ball at a higher trajectory.

The foregoing description included a standard goal set up, with the plane of the face of the goal perpendicular to the ground. With reference to FIG. 5, another variation may be understood. Using an alternate pair of base supports 20A, 22A, having the support tubes 21A, 22A angled at an angle less than 90°, and a net (not shown in FIG. 5) cut to fit the new angle, the rebounding goal will tend to throw the rebounded ball on an upwards trajectory out of the goal. This will allow players to practice taking high shots on goals, including headers.

The structure of this soccer goal permits the following exercises, drills, and methods of use:

(a) pregame warmup—standing approximately 4 to 5 feet in front of the goal, players kick the ball into the net, taking control of the rebounded ball, alternating right and left feet and the intensity of the kicks;

(b) rapid fire—standing approximately 5 feet in front of the goal, player kicks the ball into the net and continues kicking the ball as the net returns it, repeating with 10 to 20 kicks;

(c) followup/rebounding—standing approximately 20 feet in front of the goal, player takes a shot on goal and immediately follows up with a "rebounding" shot into the goal as the net returns the ball;

(d) power kick—from varied distances, player takes a full "power kick" at the goal, keeping the ball down in the goal, using the rebounding net to keep the ball in play;

(e) dribble power—starting approximately 35 yards away from the goal, player dribbles the ball to within reasonable striking distance and then takes a power shot on goal, using the rebounding net to keep the ball in play;

(f) football—two or three players are situated approximately three yards in front of the goal, and the players take turns kicking the rebounding ball;

(g) high shot—with a ball suspended on a holder (such as a cut off cone), player takes a shot on goal from the high (suspended) ball and then takes a follow up on the rebounded ball;

(h) volley kick—from behind the goal, a teammate or coach feeds the ball to the player (over the goal in an arching fashion), so that the player may immediately trap the ball with head, knee or chest and take a shot on goal, following up with a kick on the rebounded ball;

(i) switch back—several balls are placed in front of the goal, and a player will shoot the first ball, run to the next ball and shoot it, using the rebounding net to keep the balls in play;

(j) alternate foot/balance—several balls are aligned about five feet in front of the goal, approximately one foot apart, and a player will hop on one foot, kicking the ball with the other foot, progressing from ball to ball, using the rebounding net to keep the balls in play;

(k) penalty kick—the rebounding goal of this invention is set in front of one or both of the goal posts of a standard sized (regulation) goal, and arranged so that approximately half the width (four feet) of the rebounding goal is "inside" the standard goal so that the segment which is inside coincides with a desired penalty kick zone (low and to the far side of the goalie), using the rebounding net to keep the ball in play;

(l) ingame warmup—a player on the sideline awaiting substitution into the game can use the rebounding goal for a continuous warmup, using the rebounding net to allow the player to remain close in front of the rebounding goal and to avoid run away balls;

(m) short field soccer—teams of players can use the rebounding goal almost anywhere, varying the field size according to the players, objectives, number of players and space, thereby setting up a game of short field soccer, using fewer players and sometimes no goalie, a 3-person team ("3v3") or a 4-person, 5, 6, 7, 8 or other "short-handed" teams may be fielded.

Accordingly, it can be understood that this invention provides a soccer goal that is safe, stable, light weight, portable, easy to setup and disassemble, and that also returns the ball to the kicker after the ball is struck into the net.

What is claimed is:

1. A rebounding soccer goal, comprising:

(a) a right horizontal tube member having a curved 90° bend to the vertical at one end thereof;

(b) a left horizontal tube member having a curved 90° bend to the vertical at one end thereof;

(c) a horizontal connecting tube for connecting the right and left horizontal tube members, forming thereby a long horizontal bar having curved 90° bends to the vertical at both ends thereof;

(d) a right base support having a right vertical support tube enclosing a first prong and a second prong, said first prong and said second prong being sharpened ends of a single rod, said rod being bent into a bent section with said sharpened ends pointing downwards and said rod being oriented so that said bent section is enclosed within the right vertical support tube, said right vertical support tube extending above a playing surface when the prongs are driven into the surface;

(e) a left base support having a left vertical support tube enclosing a first prong and a second prong, said first prong and said second prong being sharpened ends of a single rod, said rod being bent into a bent section with said sharpened ends pointing downwards and said rod being oriented so that said bent section is enclosed within the left vertical support tube, said left vertical support tube extending above a playing surface when the prongs are driven into the surface;

(f) a right vertical post telescopically attached to the right vertical support tube of the right base support member so as to stand above the playing surface;

(g) a left vertical post telescopically attached to the left vertical support tube of the left base support member so as to stand above the playing surface;

(h) wherein the long horizontal bar is telescopically attached, at the curved 90 bends to the vertical thereof, to the right and left vertical posts, forming thereby a goal frame standing above the playing surface;

(i) a right strut pivotally attached, at one end thereof to the right vertical post at a point on the rear of the post, said strut extending backwards and downwards so as to contact said playing surface behind the post;

(j) a left strut pivotally attached, at one end thereof to the left vertical post at a point on the rear of the post, said strut extending backwards and downwards so as to contact said playing surface behind the post;

(k) a net having a portion near the periphery thereof corresponding to the goal frame folded back over itself to form a sleeve, said sleeve threaded over said frame so as to removably connect the net and frame, and said net being disposed behind the frame at the outside of said left and right struts;

(l) a right hook attached to one of said net or said right base support near the juncture of the prongs and the right vertical support tube;

(m) a left hook attached to one of said net or said left base support near the juncture of the prongs and the left vertical support tube;

(n) wherein said net is removably connected to the right and left base supports by the right and left hooks;

(o) a mainstay cord threaded into the net near the periphery thereof, a portion of said mainstay cord being removably attached to the right and left base supports by the right and left hooks;

(p) a pair of spikes, one to secure each of the left and right struts to the playing surface after the struts are spread outwards so as to pull the net outwards;

wherein the mainstay cord of the net, the sleeve of the net, the hooks holding the net to the base supports, and the struts cooperate so as to impart a tension to the net, said net thereby using said tension to rebound a ball kicked into the net.

2. The apparatus of claim 1, wherein the left strut and right strut each further comprise a hooked end, said hooked end having a hooked segment joined to said strut by an extension segment.

3. The apparatus of claim 2, wherein an angle formed between the extension segment and the strut is in the range of 45° to 65°.

4. The apparatus of claim 2, wherein said left and right vertical posts each have a hole therein and an interior wall so that the hooked ends of said struts may be inserted through said holes, each strut thereby making a three-point contact with the respective post, said three-point contact including a first contact point where said hooked end meets said hole, a second contact point where a bend of the hooked segment meets the interior wall opposite said hole, and a third contact point where an end of the hooked segment meets the interior wall above said hole.

5. A method of assembling a rebounding soccer goal, comprising:

(a) threading the sleeve of a net through at least one of two horizontal bars, each horizontal bar having a bent end and a non-bent end;

(b) pushing a horizontal connector into the non bent end of the horizontal bar on which the net is threaded;

(c) pushing the non-bent end of the other horizontal bar over the other end of the horizontal connector, thereby forming one long horizontal tube, bent at each end with the net threaded through one end;

(d) placing the long horizontal tube on a playing surface and aligning said long horizontal tube in accordance with a desired orientation for the face of the goal;

(e) driving a first and a second base support into the playing surface at each end of the long horizontal tube, using the horizontal tube to judge the width of the goal, each of said base supports having a first prong, an extending prong and a vertical support post, and orienting the prongs of said supports so that they are parallel to the face of the goal with the extending prongs on the outside of the goal, and the vertical support posts of said base supports protrude above the playing surface;

(f) pushing a first vertical post onto the vertical support post of one of said base supports, and pushing a second vertical post onto the vertical support post of the other base support;

(g) attaching a hooked end of a first strut to said first vertical post, and attaching a hooked end of a second strut to said vertical post, and spreading the struts so that a base of each of the struts rests upon the ground behind the goal;

(h) lifting the long horizontal tube and pushing the bent ends of the horizontal bars of the long horizontal tube onto the upper ends of the first and second vertical posts, forming thereby a goal frame;

(i) spreading the net by threading the sleeve thereof over the horizontal connector, the other horizontal bar, and the first and second vertical posts until the net is positively joined to the entire length of the goal frame;

(j) securing a first portion of the net to the juncture of the extending prong of the first base support and the bottom of the right vertical post, and securing a second portion of the net to the juncture of the extending prong of the second base support and the bottom of the left vertical post;

(k) pulling the net over the first and second struts; and (l) swinging at least one of said struts outwards so as to put increased tension in the net, and then removably attaching the base of each of said struts to the playing surface so as to secure the soccer goal.

* * * * *